US005423975A

United States Patent [19]

Sudhakar et al.

[11] Patent Number: 5,423,975

[45] Date of Patent: * Jun. 13, 1995

[54] SELECTIVE HYDRODESULFURIZATION OF NAPHTHA USING SPENT RESID CATALYST

[75] Inventors: Chakka Sudhakar, Wappingers Falls; Gerald G. Sandford, Glenham; Ajit K. Bhattacharya, Hopewell Junction, all of N.Y.

[73] Assignee: Texaco Inc., White Plains, N.Y.

[ * ] Notice: The portion of the term of this patent subsequent to Feb. 15, 2011 has been disclaimed.

[21] Appl. No.: 910,051

[22] Filed: Jul. 8, 1992

[51] Int. Cl.[6] ..... C10G 45/04

[52] U.S. Cl. ..... 208/216 R; 208/213; 208/216 PP; 208/217; 208/251 H

[58] Field of Search ..... 208/213, 216 R, 216 PP, 208/217, 251 H

[56] References Cited

U.S. PATENT DOCUMENTS

| | | | |
|---|---|---|---|
| 2,793,170 | 5/1957 | Stiles et al. | 208/216 R |
| 3,876,523 | 4/1975 | Rosinski et al. | 208/251 H |
| 3,876,532 | 4/1975 | Plundo et al. | 208/216 |
| 4,414,102 | 11/1983 | Rankel et al. | 208/216 |
| 5,286,373 | 2/1994 | Sudhakar et al. | 208/217 |

*Primary Examiner*—Asok Pal
*Assistant Examiner*—Warren D. Griffin
*Attorney, Agent, or Firm*—Henry H. Gibson

[57] ABSTRACT

Naphtha is selectively hydrodesulfurized using spent resid upgrading catalyst to remove sulfur while minimizing loss in octane level due to olefin saturation.

9 Claims, No Drawings

SELECTIVE HYDRODESULFURIZATION OF NAPHTHA USING SPENT RESID CATALYST

BACKGROUND OF THE INVENTION

1. Field of the Invention

This invention concerns a process for removing sulfur from naphtha, a petroleum product used to make fuels like gasoline. Specifically, spent resid catalyst is used to selectively hydrodesulfurize naphtha while minimizing olefin saturation.

2. Description of Related Information

It is well known that air pollution is a serious environmental problem. A major source of air pollution worldwide is the exhaust from hundreds of millions of motor vehicles due to fuel combustion. Laws and regulations have been enacted reflecting the need to reduce harmful motor vehicle emissions through more restrictive fuel standards. Fuels containing sulfur produce sulfur dioxide and other pollutants leading to a host of environmental concerns, such as smog and related health issues, acid rain leading to deforestation, water pollution, as well as other environmental problems. To help reduce or eliminate these environmental problems, the sulfur content of fuels has been, and will continue to be, restricted to increasingly smaller concentrations, such as less than 100 or even 50 parts per million (ppm).

The problem of sulfur in fuels is compounded in many areas where there is diminishing or no domestic source of crude oil having relatively low sulfur content. For example, in the United States the supply of domestic oil production relies increasingly on lower grade crude oil with higher sulfur content. The need for lower sulfur content fuel therefore increases demand for imported oil having lower sulfur content increasing trade imbalance and vulnerability due to dependence on foreign sources of oil.

The sulfur content in crude oil can take the form of a wide variety of both aliphatic and aromatic sulfurous hydrocarbons. Various techniques have been developed for removing sulfur compounds. One such technique, called hydrodesulfurization (HDS), involves catalytically reacting hydrogen with the sulfur compounds. The general HDS reaction is illustrated in Equation 1.

$$RSR' + H_2 \rightarrow RH + R'H + H_2S$$

Equation 1: Hydrodesulfurization Reaction

In Equation 1, the sulfur compound, RSR', may be: a thiol or mercaptan, where R is hydrocarbyl and R' is hydrogen; a sulfide or disulfide, where the sulfur is connected to another sulfur atom in R or R' hydrocarbyl groups; or may be a thiophene where R and R' are connected to form a heterocyclic ring. The HDS reaction consumes hydrogen ($H_2$) and produces hydrogen sulfide ($H_2S$) and hydrocarbons wherein the sulfur atom is replaced by two hydrogen atoms. The hydrogen sulfide can then be separated to give a petroleum product in which the sulfur is significantly reduced or substantially eliminated.

Petroleum refining includes the treatment of residual petroleum fractions, also called resid or bottoms, which are mixtures of higher boiling point hydrocarbons remaining after distilling lower boiling point materials from crude petroleum, in order to produce more valuable material from these residues by processes known as resid upgrading. Resid upgrading typically uses catalyst and heat at high hydrogen pressures to reform or convert, such as by catalytic hydroprocessing, residues to lower molecular weight and/or lower boiling point hydrocarbons, combined with desulfurization and demetallation.

Various resid upgrading catalysts, i.e. resid catalysts, have been described and/or used. See, for example, *The Desulfurization of Heavy Oils and Residua*, by J. G. Speight, Chapter 7, Marcel Dekker, New York (1981) and the *Oil and Gas Journal*, Oct. 14, 1991, pages 43–78.

Substantial amounts of carbonaceous, metal and/or other materials are generally deposited from the resid material onto the catalyst during its use. These deposits accumulate within the pores of the catalyst support decreasing pore volume and significantly reducing the surface area of the catalyst, resulting in diminished catalyst activity. These deposits cause the resid catalysts to lose upgrading activity producing spent resid catalyst. Spent resid catalyst generally has relatively small pore volume, typically about 0.2 cubic centimeters per gram (cc/g), and a highly reduced surface area, typically of about 50 square meters per gram ($m^2/g$), as compared to a pore volume of about 0.8 cc/g and a surface area of about 300 $m^2/g$ for fresh resid catalyst. Due to the large amounts and kinds of deposits it is generally not economically viable to regenerate spent resid catalysts. Additionally, due to high, including toxic, metallic content, spent resid catalysts are frequently classified as hazardous waste and are difficult and expensive to dispose of in an environmentally sound manner, such as for metals recovery or destruction of other toxic material.

Spent hydrotreating catalysts have been used in hydrotreating, including HDS. For example, U.S. Pat. No. 3,876,532 (Plundo et al.) discloses a process for hydrotreating middle distillate, virgin oils using spent hydrotreating catalyst under extremely mild conditions to reduce acid and mercaptan content, to remove sulfur below 0.2 weight percent, or 2,000 ppm. U.S. Pat. No. 4,414,102 (Rankel et al.) discloses the use of spent HDS catalyst to transform nitrogen- or oxygen-containing compounds to sulfur-containing compounds followed by mild HDS treatment.

It would be desirable to have a process for removing sulfur from fuel feedstocks like naphtha, containing olefins, which minimizes loss of octane value, using an inexpensive procedure, to provide a cleaner environment along with a more stable economy.

SUMMARY OF THE INVENTION

This invention concerns a process for selectively hydrodesulfurizing naphtha. The process comprises contacting naphtha, containing thiohydrocarbons and olefins, with hydrogen in the presence of spent resid upgrading catalyst under hydrodesulfurization conditions to selectively make hydrogen sulfide and desulfurized hydrocarbons while retaining high olefin content.

DETAILED DESCRIPTION OF THE INVENTION

This invention enables the selective HDS of naphtha while minimizing olefin saturation. This is achieved using spent resid upgrading catalyst.

The naphtha which may be used in this process is essentially any petroleum material containing significant amounts of olefins and thiohydrocarbons. Generally, the naphtha is a mixture of hydrocarbons distilled from crude oil or made directly or indirectly by cracking or other processing. Cracked naphtha is a fraction derived from catalytic or thermal cracking operations of heavier petroleum fractions. The term hydrocarbon means compounds having hydrogen and carbon atoms. Hydrocarbons may be cyclic or acyclic, including straight- or branched-chain, saturated or unsaturated, including aromatic, and may be unsubstituted or substituted with other elements such as sulfur, oxygen, nitrogen, halogen, as well as metals or others elements found in petroleum. The term thiohydrocarbon means hydrocarbon compounds containing sulfur. The term olefin means nonaromatic, unsaturated hydrocarbons. The naphtha will typically have a boiling range of from about 50° C. to about 200° C., and a maximum boiling point of up to about 230° C.

The sulfur content in the naphtha may be any amount for which sulfur removal is desired. Typically, the naphtha contains from about 0.05 to about 0.5 weight percent sulfur. The sulfur may be present in any, typically hydrocarbonaceous, form. Generally, sulfur is present as a mixture of thiohydrocarbons, including mercaptans, sulfides, disulfides and heterocyclic compounds like thiophenes, such as described in Equation 1 previously.

The olefins contained in the naphtha have one or more ethylenic unsaturation, such as acyclic or cyclic olefins, diolefins and the like. The olefins contribute to the anti-knocking property of the composition, as may be shown by the octane number of the composition. Typically, the total amount of olefins is from about 10 to about 60, preferably from about 10 to about 50, and most preferably from about 15 to about 45 volume percent of the naphtha.

The hydrogen may be provided as substantially pure hydrogen gas or may contain inert or other gases, including light hydrocarbons. Any hydrogen not consumed during the reaction may be isolated and recycled for reuse. The hydrogen is generally provided as hydrogen-containing gas with a major amount of, over half up to nearly pure, hydrogen gas with the balance being inert or hydrocarbonaceous gases. The amount of hydrogen used may be any amount effective for HDS to occur. Typically, hydrogen is added, for continuous reactions, at gas hourly space velocity (GHSV) rates of from about 70 to about 1,000, preferably from about 70 to about 500, and most preferably from about 90 to about 270, $m^3$ $H_2/m^3$ feedstock.hour.

The spent resid upgrading catalyst is a material which selectively hydrodesulfurizes the naphtha, producing desulfurized hydrocarbons, while retaining a high level of olefins in the naphtha. Typically, the catalyst comprises Group VI and Group VIII metals provided on a porous support. Preferred Group VI metals include chromium, molybdenum and tungsten. Preferred Group VIII metals include cobalt and nickel. Additional metals or other elements can be present, such as phosphorus, fluorine, titanium, boron, and the like. Particularly preferred metals include nickel and molybdenum, with or without phosphorus. The support may be any material effective at supporting the catalytic agents. Illustrative supports include, among others, one or mixtures of the following: metal oxides including alumina, magnesia, silica, titania, and zeolites; carbon; and the like. Alumina is preferred.

The catalyst is generally a spent resid upgrading material including any material which, prior to deactivation, is effective for resid upgrading reactions. The term resid identifies any catalyst useful for hydroprocessing or upgrading petroleum residues. The particular catalyst composition and structure is not narrowly critical. Any effective, including known, spent resid upgrading catalyst which can provide selective hydrodesulfurization of naphtha can be used. The amount of catalytic agents relative to support typically ranges from about 2% to about 60%, preferably from about 5% to about 50%, and most preferably from about 8% to about 40% of the total fresh support and catalyst, without the deactivating deposits. The amount of deactivating deposits will vary depending on the factors influencing deposition like resid type, upgrading conditions, catalyst characteristics, and duration of use. Petroleum residues generally contain significant amounts of metals, such as vanadium, iron and nickel, and other materials, including arsenic, silicon, sodium lead, copper, sulfur, nitrogen and oxygen, which are deposited on the resid catalyst in a manner, such as by obstructing pores, leading to generally irreversible deactivation of the resid catalyst. The resid catalyst becomes spent when it is deactivated to the extent that its upgrading activity falls to commercially undesirable levels. The spent resid catalyst will generally have at least about 0.5%, and typically from about 1% to about 50%, of the total spent catalyst of deactivating metal deposits, such as poisoning metals like external nickel, iron and/or vanadium. The surface area, pore volume, density, and other properties of the catalyst may be any effective, including known, amounts characterizing spent resid catalyst. The total pore volume in the spent catalyst typically ranges from about 0.05 to about 0.5, preferably from about 0.1 to about 0.4 cubic centimeters per gram (cc/g). The surface area, such as determined by the BET method, is generally from about 10 to about 200, preferably from about 10 to about 100, square meters per gram ($m^2/g$).

Resid catalysts may be produced using any effective, including known, procedure, such as described in *The Desulfurization of Heavy Oils and Residua*, by J. G. Speight, Chapter 7, Marcel Dekker, New York (1981) and the *Oil and Gas Journal*, Oct. 14, 1991, pages 43–78. Spent resid catalysts may be obtained from resid upgrading operations. Alternatively, the spent resid catalyst can be produced by any other manner which makes a catalyst having the characteristics of spent resid catalyst. Any effective resid upgrading operations may be used. Typical resid upgrading operations are conducted: at temperatures ranging from about 370° C. to about 460° C.; hydrogen partial pressures of from about 35 to about 350 bars; at feedstock flow rates ranging from about 0.1 to about 2 LHSV; using any effective catalyst configuration including fixed bed, moving bed, fluidized bed, well-stirred reactor or, preferably, an ebullated bed; or using other established procedures.

The spent resid catalyst does not generally need any treatment or preparation before using in the HDS process, although pretreatment or other preparation of the catalyst may be conducted, if desired. Typically, the catalyst is already in a sulfided state from prior resid upgrading use or equivalent preparation.

The catalyst may be used in any effective, including known, form. For example, the catalyst may be used in a fixed bed, fluidized bed, and the like. Fixed bed catalysts are preferred.

The naphtha HDS is conducted under any effective, including known, conditions. The operating conditions can vary depending upon the particular catalyst, naphtha and amount of sulfur removal desired. Typically, the temperature can range from about 150° C. to about 500° C., preferably from about 200° C. to about 400° C., and most preferably from about 250° C. to about 400° C. The pressure is generally at least about 10 bars and typically ranges from about 10 to about 100, preferably from about 15 to about 70, and most preferably from about 15 to about 55, bars. The naphtha is contacted with catalyst for a time sufficient to cause hydrodesulfurization. The contact time can be expressed in terms of the flow rate of the process stream, such as having a liquid hourly space velocity (LHSV) in terms of the volume of feedstock per volume of catalyst per hour, which typically ranges from about 0.5 to about 15, preferably from about 1 to about 10. The HDS reaction may be conducted using any effective, including known, means or reactor.

Other materials, if desired, may be present or optionally included in the HDS reaction, provided they do not significantly interfere with the selective naphtha HDS. Illustrative optional materials include, among others, one or mixtures of the following: ammonia, hydrogen sulfide, and the like.

In a typical embodiment, spent resid catalyst is placed in a hydrotreating reactor vessel. Hydrogen is passed through the reactor, to purge oxygen, and the catalyst bed is slowly heated to a pre-reaction temperature, such as 100° C., with hydrogen flow. Naphtha feedstock is then added, such as at a LHSV rate of about 2, and the pressure increased, such as to about 27 bars, followed by heating to the reaction temperature, such as about 360° C. for the hydrotreating reaction to proceed.

The product of the selective HDS, such as illustrated by Equation 1 previously, is desulfurized naphtha retaining high olefins content, and sulfur products consisting essentially of hydrogen sulfide. Generally, the desulfurized naphtha has a substantially reduced amount, generally less than about 30 wt. %, and preferably less than about 20 wt. % of the thiohydrocarbons present in the naphtha feedstock. The olefin content in the desulfurized naphtha is generally at least about 50 wt. %, and preferably 70 wt. % or more of the amount present in the naphtha feedstock. The desulfurized naphtha thereby retains a significant octane value as compared with the original octane value of the naphtha.

HDS selectivity is provided when HDS activity exceeds the activity of other reactions, such as olefin hydrogenation. The extent of HDS selectivity can be determined by any technique for measuring thiohydrocarbon content before and after the HDS reaction as compared with the content of other materials, especially olefins, undergoing hydrotreating reactions, such as hydrogenation. HDS selectivity occurs when the degree of HDS, such as measured by the relative proportions of thiohydrocarbons removed by HDS, exceeds the degree of another hydrotreating reaction, like olefin hydrogenation such as measured by the relative proportion of olefins removed by hydrogenation. Significant HDS selectivity is provided by the spent resid catalyst.

The hydrogen sulfide or other sulfur products can be removed from the naphtha using any effective, including known, procedure. Typical sulfur removing procedures include, among others: gas sparging, such as with hydrogen or nitrogen; caustic scrubbing; sorption; or the like.

Desulfurized naphtha containing very low sulfur content can be produced. Depending upon the initial sulfur content, feedstock, HDS conditions and other factors influencing sulfur removal, the desulfurized naphtha will generally have less than about 300, preferably less than about 200, and most preferably less than about 170 weight parts per million (ppm) sulfur.

The spent resid catalyst can provide prolonged HDS selectivity, diminishing slowly with time, since the catalyst has already undergone significant deactivation. Such prolonged activity provides increased ease of operation as well as greater efficiency and reduced costs, particularly as compared to the use of hydrotreating catalyst having normal deactivation rates.

Another advantage of the selective HDS is a low level of hydrogen consumption relative to normal HDS or hydrotreating operations. This is a result of the low level of hydrogenation due to low catalytic hydrogenation activity. This not only saves on the cost of hydrogen but provides improved operation and control of the HDS reaction due to lower reaction heat generation as compared to using normal hydrotreating catalyst.

Although not bound to any particular explanation, it is believed that the selective HDS achieved by this invention is possible because the spent resid catalyst combines a significantly reduced level of hydrogenating activity with a relatively high level of hydrodesulfurizing activity. This increased hydrodesulfurizing selectively of the catalyst enables highly effective sulfur removal from naphtha with minimal olefin saturation.

The use of spent resid catalyst is advantageous in providing a low cost source of HDS catalyst. In addition, the reuse of spent catalyst defers the problem of disposing of the catalyst until after the selective HDS activity is diminished following prolonged use.

The following examples illustrate some embodiments of this invention and are not intended to limit its scope. All percentages and amounts given in the disclosure and claims are based on weight, unless otherwise stated.

EXAMPLES

Terms used in the examples have the following meanings:

| TERM | DESCRIPTION |
|---|---|
| Catalyst 1 | Fresh resid catalyst which is a 0.8 mm diameter extrudate having 8.8% molybdenum and 2.3% nickel on alumina, called HDS-1443B by the Criterion Catalyst Co. L.P. |
| Catalyst 2 | Catalyst 1 which has been used to upgrade vacuum resid, which boils above about 538° C. and has, approximately, 3.5% S, 0.3% N, 150 ppm V and 50 ppm Ni, generally at a process temperature of about 435° C. and pressure of about 150 bars at a feedstock LHSV rate of almost 0.4 for about 30 days, giving added deposits of about 1.4% Ni and 4.21% V, a total pore volume of about 0.2 cc/g and a BET surface area of about 50 $m^2/g$. |

Unless otherwise indicated, test results given in the examples use the following procedures:

Product Sulfur is the amount of sulfur in the naphtha product determined by standard x-ray fluorescence procedures, given in weight parts per million (ppm).

% HDS is the extent of sulfur removed from the naphtha, given in weight percent.

% HYD is the extent of hydrogenation based on the reduced amount of olefins in the naphtha product, measured using standard ASTM #1319 fluorescent indicator adsorption technique, given in volume percent.

HDS/HYD % is the percent hydrodesulfurization to olefin hydrogenation selectivity as measured by the percentage that the relative proportion of thiohydrocarbons, removed by HDS, given by % HDS, exceeds the relative proportion of olefins removed by hydrogenation, given in % HYD, as shown by:

$$HDS/HYD\ \% = \left(\frac{\%\ HDS}{\%\ HYD} - 1\right) \times 100$$

Examples 1C–4: Hydrodesulfurization Processes and Analysis

These examples describe illustrative embodiments of this invention. Data and variables are given in Table 2. Examples 1C through 3C, using fresh resid upgrading catalyst, are given for comparison. The naphtha used in the examples is a fluid catalytically cracked naphtha having the properties and compositions shown in Table 1.

TABLE 1

| Naphtha Feedstock Composition | |
|---|---|
| Specific Gravity | 58.2 |
| Initial Boiling Point | 33° C. |
| 10%[a] | 54° C. |
| 20%[a] | 63° C. |
| 30%[a] | 72° C. |
| 40%[a] | 84° C. |
| 50%[a] | 99° C. |
| 60%[a] | 117° C. |
| 70%[a] | 135° C. |
| 80%[a] | 153° C. |
| 90%[a] | 177° C. |
| 95%[a] | 196° C. |
| Final Boiling Point | 226° C. |
| S | 1,190 ppm |
| N | 20 ppm |
| Research Octane Number | 93.0 |
| Motor Octane Number | 80.5 |
| Olefins | 35%[a] |

Note to Table 1:
[a] - volume percent

In each example, 25 cc. of the designated catalyst is loaded into a hydrotreating reactor, having an inner diameter of 21 mm. and a length of 50 cm. A stainless steel thermowell, having an outer diameter of 6.4 mm. is positioned axially through the length of the reactor, to precisely measure the temperature along the catalyst bed.

In Examples 1C through 3C, the catalyst is presulfided before introducing the naphtha. Oxygen is purged from the reactor, and 200 cc./min. of sulfiding gas, consisting of 10% hydrogen sulfide in hydrogen gas, is passed through the catalyst bed for 15 minutes at room temperature and pressure. While continuing sulfiding gas flow, the temperature of the catalyst is increased at a rate of 3° C./min. to 350° C., and maintained at that temperature for 2 hours. The temperature of the reactor is then adjusted to the designated reaction temperature, continuing sulfiding gas flow. A back pressure of about 8 bars is then applied to the reactor, and the naphtha feedstock is introduced, generally at a rate of 100 cc./hour. Once naphtha feedstock has passed through the catalyst bed, the flow of sulfiding gas is stopped and the flow of hydrogen gas started at a GHSV rate of 9 $m^3\ H_2/m^3$ catalyst.hour. The naphtha feedstock flow is adjusted to 2 LHSV and the reactor pressure increased to about 28 bars. These conditions are maintained to conduct selective HDS.

In Example 4, the catalyst is used without presulfiding. Using the same reactor and catalyst loading as in the other examples, oxygen is purged from the reactor and the catalyst bed heated slowly for an hour to 100° C. while passing 75 cc./min. of hydrogen through the reactor. At 100° C., the naphtha feedstock is fed to the reactor at a rate of 50 cc./hour. Once the naphtha initially passes through the catalyst bed, the reactor pressure is increased to about 28 bars and the catalyst bed heated slowly over 3 hours to the designated reaction temperature for HDS to occur.

After at least 20 hours of operation, which is more than sufficient to reach steady state reactivity, samples of naphtha product are collected, sparged ultrasonically at 0° C. to remove dissolved hydrogen sulfide, and analyzed for sulfur and olefin content. The reaction variables and results are shown in Table 2.

TABLE 2

| Hydrodesulfurization Conditions and Results | | | | | | | |
|---|---|---|---|---|---|---|---|
| Ex. | Catalyst | Temperature (°C.) | Product Sulfur (ppm) | % HDS | Olefins (vol. %) | % HYD | HDS/HYD % |
| 1C | 1 | 285 | 66 | 94.5 | 0.7 | 98.0 | −3.6% |
| 2C | 1 | 275 | 85 | 92.9 | 1.0 | 97.1 | −4.3% |
| 3C | 1 | 265 | 204 | 82.9 | 3.7 | 89.4 | −7.3% |
| 4 | 2 | 370 | 167 | 86.0 | 27.6 | 21.1 | 308% |

The results show that fresh resid catalyst not only hydrodesulfurizes thiohydrocarbons but also selectively hydrogenates a larger proportion of olefins. In contrast, the use of spent resid catalyst in Example 4 gives highly selective HDS by removing over 85% of the sulfur while retaining a major amount of up to about 80% of the olefins.

We claim:

1. A process for selectively hydrodesulfurizing naphtha comprising contacting naphtha, containing thiohydrocarbons and olefins, with hydrogen in the presence of spent resid upgrading catalyst under hydrodesulfurization conditions to selectively make hydrogen sulfide and desulfurized hydrocarbons while retaining high olefin content of at least about 50 weight percent of the olefin present in the naphtha feedstock.

2. The process of claim 1 wherein the catalyst comprises Group VI and VIII metals on a porous support having metal deposits characteristic of petroleum residues upgrading use.

3. The process of claim 2 wherein the catalyst comprises nickel and molybdenum supported on alumina having deposits of at least 1 weight percent vanadium, iron and/or additional nickel.

4. The process of claim 1 wherein the catalyst has a total pore volume of less than about 0.5 cc/g.

5. The process of claim 1 wherein the catalyst has a surface area of less than about 200 $m^2/g$.

6. The process of claim 1 wherein the naphtha is the product of thermal or catalytic cracking of hydrocarbon mixtures.

7. The process of claim 1 during which the catalyst is not regenerated.

8. The process of claim 1 wherein the catalyst is used in a fixed bed.

9. The process of claim 1 wherein the catalyst contains irreversibly deactivating deposits of metals and other inorganic materials.

* * * * *